US011774107B2

(12) United States Patent
Leikam et al.

(10) Patent No.: US 11,774,107 B2
(45) Date of Patent: Oct. 3, 2023

(54) COOKING HOB WITH USER INTERFACE

(71) Applicant: ELECTROLUX APPLIANCES AKTIEBOLAG, Stockholm (SE)

(72) Inventors: Juergen Leikam, Rothenburg ob der Tauber (DE); Simone Probst, Rothenburg ob der Tauber (DE); Lukasz Wasinkiewicz, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 478 days.

(21) Appl. No.: 16/612,728

(22) PCT Filed: Apr. 27, 2018

(86) PCT No.: PCT/EP2018/060949
§ 371 (c)(1),
(2) Date: Nov. 11, 2019

(87) PCT Pub. No.: WO2018/206327
PCT Pub. Date: Nov. 15, 2018

(65) Prior Publication Data

US 2020/0166215 A1 May 28, 2020

(30) Foreign Application Priority Data

May 12, 2017 (EP) ..... 17170935

(51) Int. Cl.
*F24C 7/08* (2006.01)
*F24C 15/10* (2006.01)
*H05B 6/12* (2006.01)

(52) U.S. Cl.
CPC ..... *F24C 7/083* (2013.01); *F24C 15/102* (2013.01); *H05B 6/1245* (2013.01)

(58) Field of Classification Search
CPC ..... F24C 15/102; F24C 15/105; F24C 7/083; H05B 6/1245
(Continued)

(56) References Cited

U.S. PATENT DOCUMENTS

2007/0164017 A1* 7/2007 Gouardo ..... H05B 6/065 219/626
2007/0178728 A1* 8/2007 Barrena ..... H01H 19/62 439/108
(Continued)

FOREIGN PATENT DOCUMENTS

CN 202040856 11/2011
CN 102396294 3/2012
(Continued)

OTHER PUBLICATIONS

International Search Report and Written Opinion in PCT/EP2018/060949 dated Jun. 14, 2018, 13 pages.
(Continued)

*Primary Examiner* — Sang Y Paik
(74) *Attorney, Agent, or Firm* — Pearne & Gordon LLP

(57) ABSTRACT

The present invention relates to a cooking hob (10) comprising at least one cooking area (12) and at least one user interface (14), wherein the cooking area (12) is subdivided into cooking zones, each cooking zone is activatable at a predefined power level and the user interface (14) comprises a position indicator device (18) for indicating a position of at least one cooking vessel on the cooktop.

19 Claims, 3 Drawing Sheets

Figure 1:
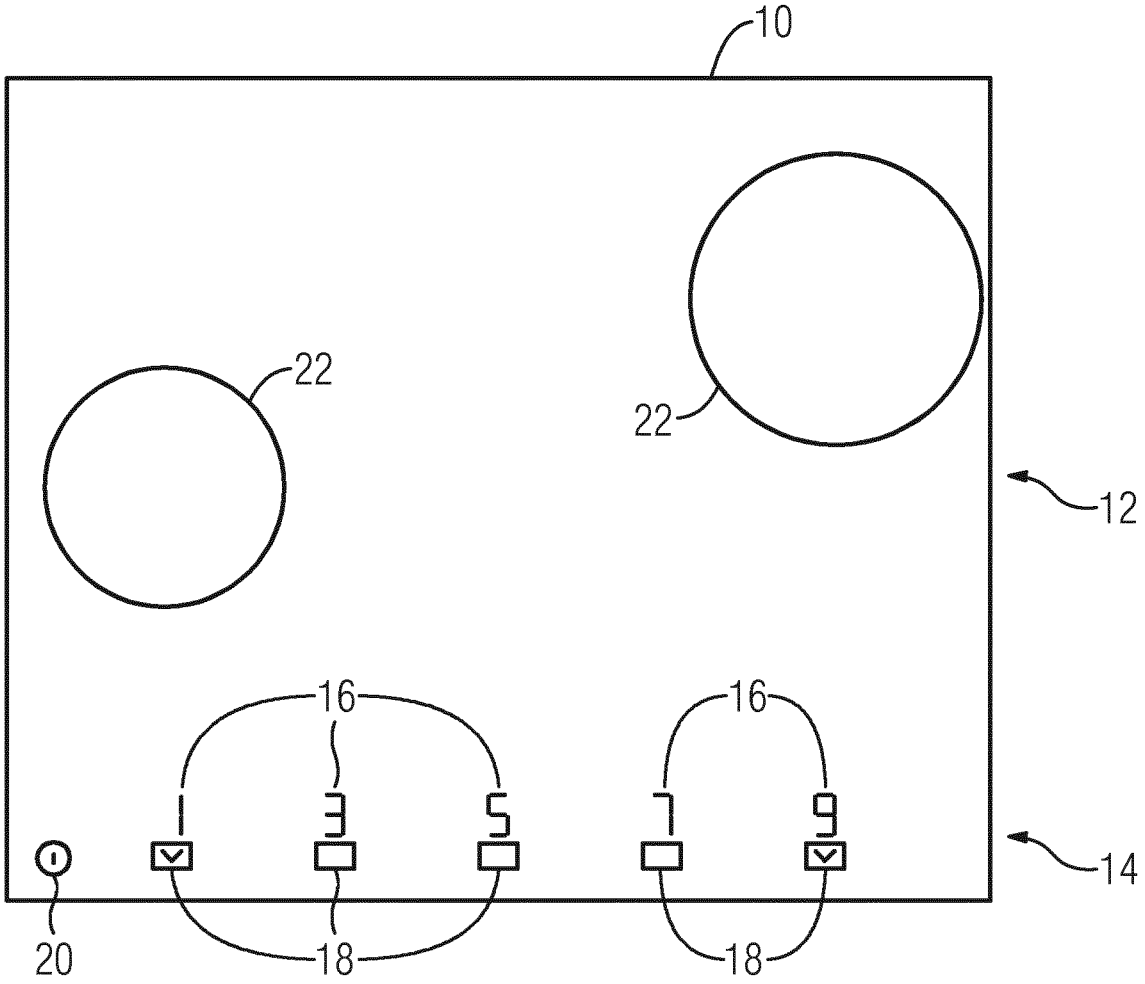

(58) Field of Classification Search
USPC ..... 219/443.1–468.2, 620–621
See application file for complete search history.

(56) References Cited

U.S. PATENT DOCUMENTS

| | | | | |
|---|---|---|---|---|
| 2012/0118714 | A1* | 5/2012 | Shigeoka | H03K 17/962 200/181 |
| 2016/0050720 | A1* | 2/2016 | Jeanneteau | F24C 7/083 219/445.1 |
| 2016/0084507 | A1 | 3/2016 | Ortmann | |

FOREIGN PATENT DOCUMENTS

| | | | |
|---|---|---|---|
| CN | 102980217 | | 3/2013 |
| DE | 102009001934 | A1 | 9/2010 |
| DE | 102013206758 | A1 | 10/2014 |
| DE | 102013213032 | A1 | 1/2015 |
| EP | 2587162 | | 5/2013 |
| EP | 2688366 | A1 | 1/2014 |
| EP | 2800453 | A1 | 11/2014 |
| EP | 2931005 | A1 | 10/2015 |
| WO | 2009053279 | A1 | 4/2009 |
| WO | 2016010490 | A1 | 1/2016 |

OTHER PUBLICATIONS

Chinese office action (English translation) for CN 201880030384.8 dated Jul. 23, 2021, 13 pages.
Australian office action for application No. AU 2018264889 dated Mar. 29, 2023, 4 pages.

* cited by examiner

COOKING HOB WITH USER INTERFACE

The present invention relates to a cooking hob with user interface. In particular, the present invention relates to an induction cooking hob with user interface.

A cooking area of a cooking hob is provided for different power levels. Mostly, the coking area comprises several cooking zones. A user interface is provided for indicating the power levels of the cooking zones. Usually, a user has to perform one or more steps in order to obtain information about the power levels of the cooking zones.

It is an object of the present invention to provide a cooking hob with user interface, which provides a clear representation of the power levels of the cooking zones by low complexity.

The object of the present invention is achieved by the cooking hob as disclosed here. Particular embodiments of the present invention also are described in the description and in the figures.

According to the present invention a cooking hob comprises at least one cooking area and at least one user interface, wherein:

- the cooking area is subdivided into cooking zones,
- each cooking zone is activatable (or: operable), especially only activatable (or: only operable), at a predefined power level, especially in at least one operating mode, and
- the user interface comprises a position indicator device for indicating a position of at least one cooking vessel on the cooktop.

The present invention allows a clear permanent representation of the power levels and the activated cooking zones by low complexity. It is not necessary, that the user performs any operation step in order to obtain information about the power levels of the cooking zones. For example, the positions of the cooking vessels are detected and the heating elements beneath said cooking vessels are activated automatically.

Preferably,

- each cooking zone is only activatable and/or operable at a (or: one) predefined power level, especially in at least one operating mode and/or
- the user interface is arranged in front of or besides the cooking area and/or
- the user interface comprises a power level indicator device including a set of power indicator elements and/or
- each indicator element corresponds with one cooking zone of the cooking area and indicates the power level of said cooking zone and/or
- the position indicator device is adapted for indicating positions of cooking vessels upon the cooking area along a direction.

Preferably, each power indicator element is arranged in front of or besides the corresponding cooking zone.

In particular, the power indicator elements are numeric indicator elements.

For example, the power indicator elements are imprinted on the user interface.

Alternatively, the power indicator elements are seven-segment displays.

Further, the position indicator device may include a set of symbolic indicator elements, wherein each symbolic indicator element corresponds with one cooking zone of the cooking area and indicates if the cooking vessel is placed upon the corresponding cooking zone.

According to another embodiment, the position indicator device includes a plurality of light source elements arranged in series and extending parallel to an edge of the cooking area.

Preferably, the light source elements are light emitting diodes (LED), so that an LED line is formed.

According to a special embodiment, the position indicator device includes two parallel series of light source elements extending parallel to the edge of the cooking area, wherein each series corresponds with one portion of the cooking area.

Further, the position indicator device may include light source elements of different colours.

In particular, the predefined power levels for the cooking zones are determined during manufacture of the cooking hob. Said predefined power levels allow a low complexity of the cooking hob.

Alternatively, the predefined power levels for the cooking zones are predetermined and/or are adjusted or adjustable by the user. Preferably the power distribution on the cooking area is adjusted or adjustable by the user. In the latter case, the combination of the power levels for the cooking zones may be adjusted by the user.

In particular, the user interface is arranged in front of the cooking area and extends substantially over the whole width of said cooking area, wherein the cooking zones are arranged side by side within the cooking area.

Moreover, the user interface comprises an on-off switch for activating and deactivating the whole cooking hob.

Furthermore, the cooking area may comprise a plurality of heating elements, in particular induction coils and/or the cooking hob can be an induction cooking hob.

Preferably, the heating elements are arranged as a matrix.

At last, the cooking area and the user interface may be integrated parts of the cooking hob.

Novel and inventive features of the present invention are set forth in the appended claims.

Figure 2:
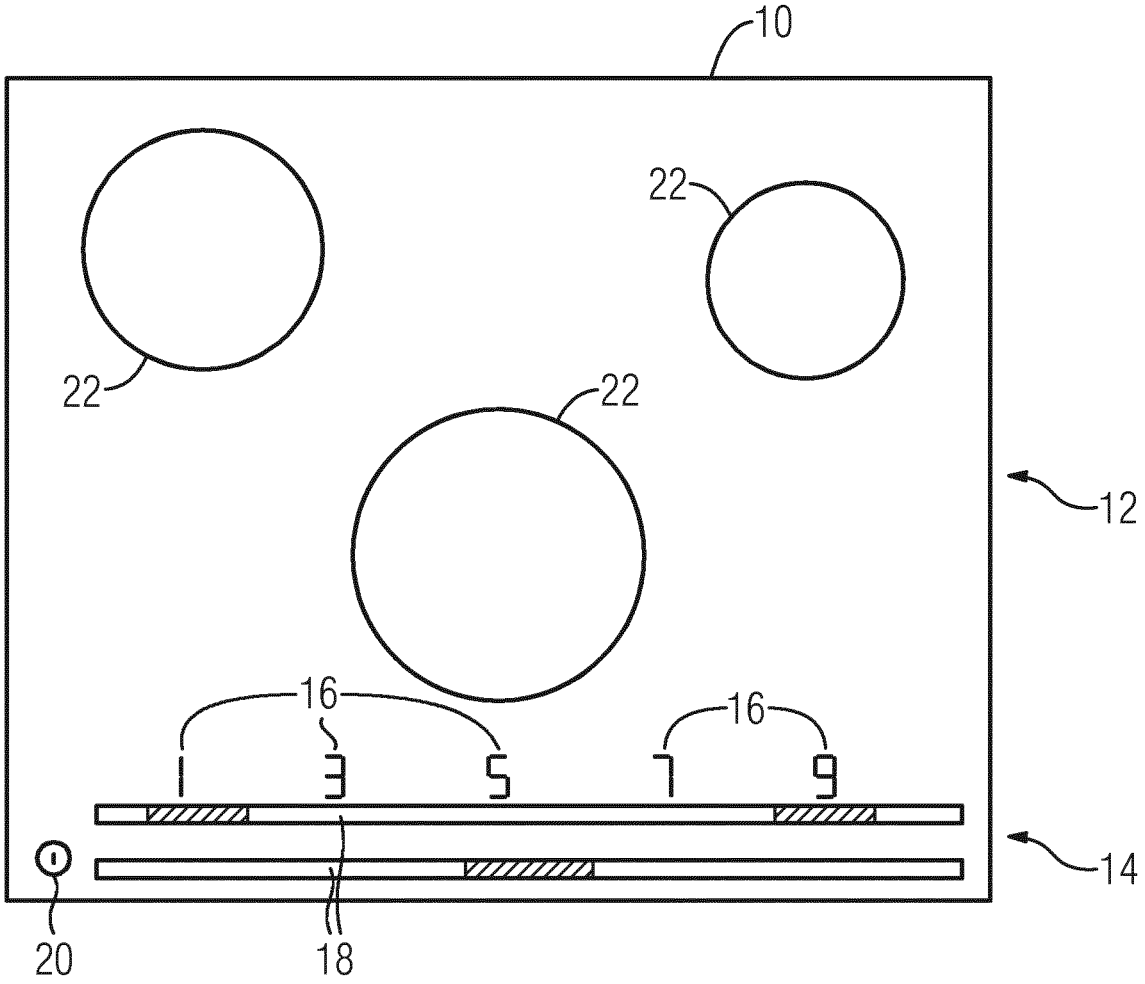
Figure 3:
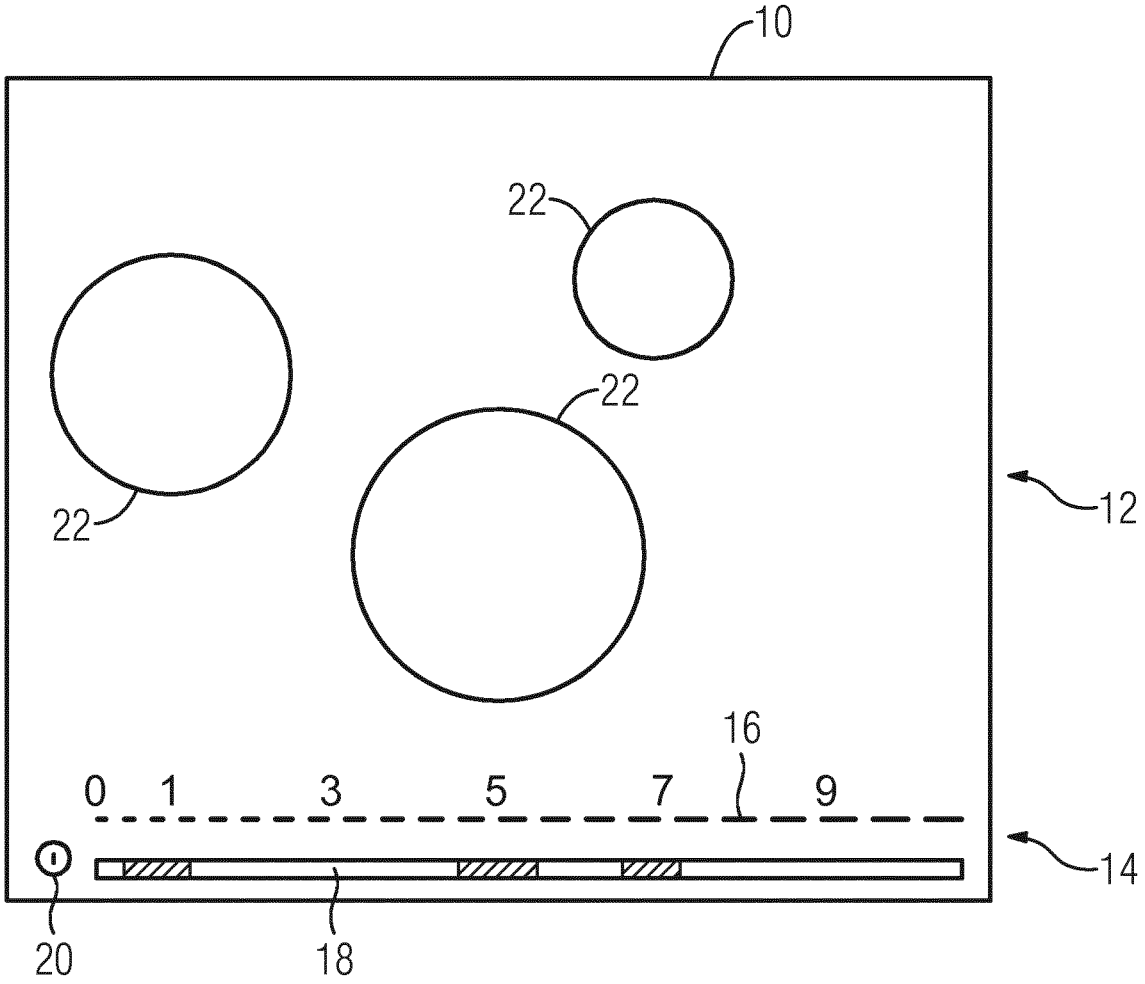

The present invention will be described in further detail with reference to the drawings, in which FIG. 1 illustrates a schematic top view of a cooking hob according to a first embodiment of the present invention, FIG. 2 illustrates a schematic top view of the cooking hob according to a second embodiment of the present invention, and FIG. 3 illustrates a schematic top view of the cooking hob according to a third embodiment of the present invention.

FIG. 1 illustrates a schematic top view of a cooking hob 10 according to a first embodiment of the present invention. The cooking hob 10 comprises a cooking area 12 and a user interface 14.

The cooking area 12 comprises a plurality of heating elements, which are not explicitly shown. For example, the heating elements are induction coils. Said heating elements are separately activatable and deactivatable in dependence of the presence of a cooking vessel 22 upon said heating elements. The cooking area 12 is subdivided into cooking zones. In this example, the cooking zones are arranged side by side. In general, the cooking zones may be arranged in an arbitrary way. For each cooking zone a specific power level is predefined. In particular, the specific power level for each cooking zone is determined during manufacture, which allows a low complexity of the cooking hob 10. Alternatively, the predefined power levels for the cooking zones may be adjustable by the user.

The cooking hob 10 is or can be an induction cooking hob. An induction cooking hob comprises induction coils as heating elements, wherein the induction coils are energized by at least one electrical circuit generating an output voltage and output current with a high frequency, in particular with a frequency of more than 10 kHz. The electrical circuit generating the output voltage and output current for the induction coils can comprise at least one IGBT (insulated-gate bipolar transistor). The power for the electrical circuit generating the output voltage and output current for the induction coils is provided by an alternating input current which is rectified by a rectifying circuit, for example a bridge rectifier.

The user interface 14 is arranged in front of the cooking area 12 and extends substantially over the whole width of the cooking hob 10. The user interface 14 comprises a power level indicator device 16, a position indicator device 18 and an on-off switch 20. The on-off switch 20 is provided for activating and deactivating the cooking hob 10.

The power level indicator device 16 includes a set of numeric indicator elements arranged in front of the cooking zones. Each numeric indicator element corresponds with one cooking zone of the cooking area 12 and indicates the power level of the corresponding cooking zone. In this embodiment the numeric indicator elements are seven-segment displays.

The position indicator device 18 includes a set of symbolic indicator elements. Each symbolic indicator element corresponds with one cooking zone of the cooking area 12 and indicates if a cooking vessel 22 is placed upon the corresponding cooking zone. In this example, the symbolic indicator elements are illuminated by light emitting diodes (LED).

In this example, the cooking area 12 is subdivided into five cooking zones arranged side by side. The cooking zone on the left hand side is provided for the lowest power level, while the cooking zone on the right hand side is provided for the highest power level. The power levels of the cooking zones increase from left to right.

In FIG. 1 a cooking vessel 22 is placed upon the cooking zone on the left hand side and a further cooking vessel 22 is placed upon the cooking zone on the right hand side. Thus, the first and the fifth, from left to right, symbolic indicator elements of the position indicator device 18 are activated, while the other symbolic indicator elements of said position indicator device 18 are deactivated. The numeric indicator elements "1" and "9" of the power level indicator device 16 correspond with the activated cooking zones. In this example, the power levels "1", "3", "5", "7" and "9" for the cooking zones are determined during manufacture, which allows the low complexity of the cooking hob 10.

Alternatively, the power levels for the cooking zones may be adjusted by the user. For example, the combination of the power levels "0", "1", "2", "3" and "4" may be adjusted by the user. Further, the combination of the power levels "5", "6", "7", "8" and "9" may be adjusted by the user. In general, an arbitrary combination of power levels for the cooking zones may be adjusted by the user.

FIG. 2 illustrates a schematic top view of the cooking hob 10 according to a second embodiment of the present invention. The cooking hob 10 comprises the cooking area 12 and the user interface 14.

The cooking area 12 comprises the plurality of heating elements, which are not explicitly shown. For example, the heating elements are induction coils. Said heating elements are separately activatable and deactivatable in dependence of the presence of the cooking vessel 22 upon said heating elements. The cooking area 12 is subdivided into cooking zones. In this example, the cooking zones are arranged side by side. In general, the cooking zones may be arranged in an arbitrary way. For each cooking zone a specific power level is predefined.

The user interface 14 is arranged in front of the cooking area 12 and extends substantially over the whole width of the cooking hob 10. The user interface 14 comprises the power level indicator device 16, the position indicator device 18 and the on-off switch 20. The on-off switch 20 is provided for activating and deactivating the cooking hob 10.

The power level indicator device 16 includes the set of numeric indicator elements arranged in front of the cooking zones, wherein each numeric indicator element corresponds with one cooking zone of the cooking area 12 and indicates the power level of the corresponding cooking zone. In this embodiment the numeric indicator elements are seven-segment displays.

The position indicator device 18 includes two parallel LED lines extending in transverse direction. Each line includes a plurality of light emitting diodes. A front LED line corresponds with a front portion of the cooking area 12, while a rear LED line corresponds with a rear portion of said cooking area 12. The LED lines of the position indicator device 18 indicate the positions of the cooking vessels 22 along the transverse direction.

In this example, the cooking area 12 is subdivided into five cooking zones arranged side by side. The cooking zone on the left hand side is provided for lowest power level, while the cooking zone on the right hand side is provided for the highest power level. The power levels of the cooking zones increase from left to right.

In FIG. 2 a first cooking vessel 22 is placed upon the cooking zone on the left hand side, a second cooking vessel 22 is placed on the central cooking zone, and a third cooking vessel 22 is placed upon the cooking zone on the right hand side. The first and third cooking vessels 22 are placed in the rear portion of the cooking area, while the second cooking vessel 22 is placed in the front portion of said cooking area 12. Thus, the first and third cooking vessels 22 are indicated by the rear LED line of the position indicator device 18, while the second cooking vessel 22 is indicated by the front LED line of said position indicator device 18. The numeric indicator elements "1", "5" and "9" of the power level indicator device 16 correspond with the activated cooking zones. Preferably, the power levels "1", "3", "5", "7" and "9" for the cooking zones are determined during manufacture, so that the cooking hob 10 is realised by low complexity.

Alternatively, the power levels for the cooking zones may be adjusted by the user. For example, the combination of the power levels "0", "1", "2", "3" and "4" may be adjusted by the user. Further, the combination of the power levels "5", "6", "7", "8" and "9" may be adjusted by the user. In general, an arbitrary combination of power levels for the cooking zones may be adjusted by the user.

FIG. 3 illustrates a schematic top view of the cooking hob 10 according to a third embodiment of the present invention. The cooking hob 10 comprises the cooking area 12 and the user interface 14.

The cooking area 12 comprises the plurality of heating elements, which are not explicitly shown. For example, the heating elements are induction coils. Said heating elements are separately activatable and deactivatable in dependence of the presence of the cooking vessel 22 upon said heating elements. The cooking area 12 is subdivided into cooking zones. In this example, the cooking zones are arranged side by side. In general, the cooking zones may be arranged in an arbitrary way. For each cooking zone a specific power level is predefined.

The user interface 14 is arranged in front of the cooking area 12 and extends substantially over the whole width of the cooking hob 10. The user interface 14 comprises the power level indicator device 16, the position indicator device 18 and the on-off switch 20. The on-off switch 20 is provided for activating and deactivating the cooking hob 10.

The power level indicator device 16 includes the set of numeric indicator elements arranged in front of the cooking zones, wherein each numeric indicator element corresponds with one cooking zone of the cooking area 12 and indicates the power level of the corresponding cooking zone. In this embodiment, the numeric indicator elements are numbers printed onto a glass ceramic panel of the cooking hob 10.

The position indicator device 18 includes one LED line extending in transverse direction and including a plurality of light emitting diodes. The LED line of the position indicator device 18 indicates the positions of the cooking vessels 22 along the transvers direction.

In this example, the cooking area 12 is subdivided into five cooking zones arranged side by side. The cooking zone on the left hand side is provided for lowest power level, while the cooking zone on the right hand side is provided for the highest power level. The power levels of the cooking zones increase from left to right.

In FIG. 3 three cooking vessels 22 are placed upon the first, third and fourth, from left to right, cooking zones of the cooking area 12. The cooking vessels 22 are indicated by the LED line of the position indicator device 18. The numeric indicator elements "1", "5" and "7" of the power level indicator device 16 correspond with the activated cooking zones.

The user interface 14 according to the present invention provides a graphic representation of the position of the cooking vessel 22 and the power level of the cooking zone, in which said cooking vessel 22 is placed, by low complexity. The user has to activate and deactivate the cooking hob 10 only, while all other operations are performed automatically.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 cooking hob
12 cooking area
14 user interface
16 power level indicator device
18 position indicator device
20 on-off switch
22 cooking vessel

The invention claimed is:

1. A cooking hob comprising a cooktop with a cooking area on a surface thereof and a user interface, wherein:

the cooking area is subdivided into cooking zones, which are arranged side by side, the user interface comprises a position indicator device for indicating a position of a cooking vessel on the cooktop, and in at least one operating mode, each said cooking zone is only operable at one respective predefined power level, wherein the predefined power levels for each of the cooking zones are determined during manufacture of the cooking hob.

2. The cooking hob according to claim 1, further comprising at least one or more of the following features:

the user interface is arranged in front of or besides the cooking area, and the position indicator device is adapted for indicating positions of cooking vessels upon the cooking area along a direction.

3. The cooking hob according to claim 2, wherein the user interface comprises a power level indicator device including a set of power indicator elements and each said power indicator element is arranged in front of or besides a corresponding one of said cooking zones.

4. The cooking hob according to claim 3, wherein each power indicator element corresponds with one of said cooking zones of the cooking area and indicates the predetermined power level of said one of said cooking zones or the power indicator elements are numeric indicator elements or the power indicator elements are imprinted on the user interface.

5. The cooking hob according to claim 3, wherein the power indicator elements are seven-segment displays.

6. The cooking hob according to claim 1, wherein the position indicator device includes a set of symbolic indicator elements, wherein each said symbolic indicator element corresponds with one of said cooking zones of the cooking area and indicates if the cooking vessel is placed upon the corresponding cooking zone.

7. The cooking hob according to claim 1, wherein the position indicator device includes a plurality of light source elements arranged in series and extending parallel to an edge of the cooking area.

8. The cooking hob according to claim 7, wherein the position indicator device includes light source elements of different colours.

9. The cooking hob according to claim 7, wherein the light source elements are light emitting diodes (LED) so that an LED line is formed.

10. The cooking hob according to claim 1, wherein the position indicator device includes two parallel series of light source elements extending parallel to an edge of the cooking area, wherein each said series corresponds with one portion of the cooking area.

11. The cooking hob according to claim 1, wherein the user interface is arranged in front of the cooking area and extends substantially over a whole width of said cooking area, wherein the cooking zones are arranged side by side within the cooking area.

12. The cooking hob according to claim 1, wherein the user interface comprises an on-off switch for activating and deactivating the whole cooking hob.

13. The cooking hob according to claim 1, wherein the cooking area comprises a plurality of induction coils or the cooking hob is an induction cooking hob, wherein the heating elements are arranged as a matrix.

14. The cooking hob according to claim 1, wherein the cooking area and the user interface are integrated parts of the cooking hob.

15. The cooking hob according to claim 1, wherein the cooking hob is configured to perform a plurality of operations automatically except user's executions of a switch-on and a switch-off of the cooking hob.

16. The cooking hob according to claim 1, wherein the power levels of the cooking zones increase from left to right.

17. A cooking hob comprising a cooktop surface having a cooking area that is subdivided into a plurality of cooking zones arranged next to one another along a first direction, each said cooking zone having associated therewith one or more heating elements adapted to be activated in response to a cooking vessel being placed on said cooktop surface in the respective cooking zone, wherein in at least one operating mode each said cooking zone is only operable at one respective predefined power level, wherein the predefined power levels for each of the cooking zones are determined during manufacture of the cooking hob, each respective predefined power level being different from the other predefined power levels of said other cooking zones, and a user interface on said cooktop surface in front of said cooking area, said user interface comprising a plurality of power level indicators, a position indicator device and a power switch, said plurality of power level indicators corresponding respectively to said cooking zones and providing an indication of the power level of each said cooking zone, said position indicator device comprising a plurality of indicator elements corresponding respectively to said cooking zones and being adapted to illuminate when said cooking vessel has been placed in the respective cooking zone in order to indicate the presence of said vessel in said cooking zone, said power switch adapted to activate or deactivate all cooking zones of said cooking hob.

18. The cooking hob according to claim 17, said plurality of cooking zones being arranged in order of increasing power level along a first direction extending a width of said cooktop surface, said user interface also extending along said first direction substantially a full width of said cooktop surface, said indicator elements comprising a first series of light source elements arranged in a first strip extending along said width of said cooktop surface, wherein individual ones or segments of said first series of light source elements illuminate to indicate when said cooking vessel has been placed in the associated cooking zone corresponding to a common lateral position therewith along said width of said cooktop surface.

19. The cooking hob according to claim 17, said cooking zones being said plurality of cooking zones being arranged in order of increasing power level along a first direction extending a width of said cooktop surface, said user interface also extending along said first direction substantially a full width of said cooktop surface, said indicator elements comprising a first series of light source elements arranged in a first strip extending along said width of said cooktop surface, and a second series of light source elements arranged in a second strip, parallel to said first strip and extending along said width of said cooktop surface, said first strip being nearer to a front edge of said cooktop than said second strip, wherein individual ones or segments of said first series of light source elements illuminate to indicate when said cooking vessel has been placed in a forward portion of the associated cooking zone corresponding to a common lateral position therewith along said width of said cooktop surface, and wherein individual ones or segments of said second series of light source elements illuminate to indicate when said cooking vessel has been placed in a rearward portion of the associated cooking zone corresponding to a common lateral position therewith along said width of said cooktop surface.

* * * * *